US007080425B2

(12) United States Patent
Smith et al.

(10) Patent No.: US 7,080,425 B2
(45) Date of Patent: Jul. 25, 2006

(54) VACUUM CANISTER AND MOUNTING BRACKET FOR USE THEREWITH

(75) Inventors: James F. Smith, Louisville, OH (US); Darrell V. Nieschwitz, Alliance, OH (US); Andrew L. Gabric, Louisville, OH (US)

(73) Assignee: H-P Products, Inc., Louisville, OH (US)

( * ) Notice: Subject to any disclaimer, the term of this patent is extended or adjusted under 35 U.S.C. 154(b) by 587 days.

(21) Appl. No.: 10/384,022

(22) Filed: Mar. 7, 2003

(65) Prior Publication Data

US 2004/0172782 A1 Sep. 9, 2004

(51) Int. Cl.
*A47L 9/22* (2006.01)
*A47L 5/38* (2006.01)

(52) U.S. Cl. ..... 15/327.6; 15/314; 15/347; 15/352; 55/DIG. 8

(58) Field of Classification Search ..... 15/314, 15/327.6, 327.7, 327.1, 327.2, 347, 352; 55/DIG. 8; 220/501, 503, 504, 553, 554
See application file for complete search history.

(56) References Cited

U.S. PATENT DOCUMENTS 1,237,164 A * 8/1917 Brooks ..... 220/501
1,630,037 A * 5/1927 Stresau ..... 220/554
3,543,325 A * 12/1970 Hamrick ..... 15/314
3,568,239 A * 3/1971 Hamrick ..... 15/314
4,527,302 A * 7/1985 Maurer et al. ..... 15/327.1
4,706,326 A * 11/1987 Romani ..... 15/314
4,729,147 A * 3/1988 Armbruster ..... 15/314
5,400,463 A * 3/1995 Attard et al. ..... 15/327.1
6,014,791 A * 1/2000 Nosenchuck ..... 15/327.1
6,146,434 A * 11/2000 Scalfani et al. ..... 55/334
6,171,356 B1 * 1/2001 Twerdun ..... 55/337
6,178,590 B1 * 1/2001 Lindsay et al. ..... 15/327.1
6,237,186 B1 * 5/2001 Griffiths ..... 15/314
6,611,989 B1 * 9/2003 Oh et al. ..... 15/327.7
6,779,228 B1 * 8/2004 Plomteux et al. ..... 15/327.6

* cited by examiner

*Primary Examiner*—Theresa T. Snider
(74) *Attorney, Agent, or Firm*—Sand & Sebolt

(57) ABSTRACT

A mounting bracket for use in association with a vacuum canister for a central vacuum system is disclosed. The mounting bracket is received within the housing of the vacuum canister and thereby divides the canister into clean and dirt collection chambers. Dirt collection chamber is adapted to receive dirt-laden air from the central vacuum system while clean chamber is adapted to re-circulate cleaned air back into the building. Mounting bracket is preferably a molded structure having a central bore. A plurality of stepped grooves are provided for receiving one of a variety of sizes of motor therein. A plurality of circuit board brackets are formed on mounting bracket, said circuit board brackets range in size so as to accommodate a range of sizes of circuit boards therein. Mounting bracket further includes a filter support formed therein. The filter support includes a quick attachment/release mechanism for installing filters thereon. Mounting bracket also includes an aperture and straight tube connection for connecting a clean chamber auxiliary intake valve assembly to the dirt collection chamber of the vacuum canister.

30 Claims, 15 Drawing Sheets

| |
|---|
| FIG-3A |
| FIG-3B |

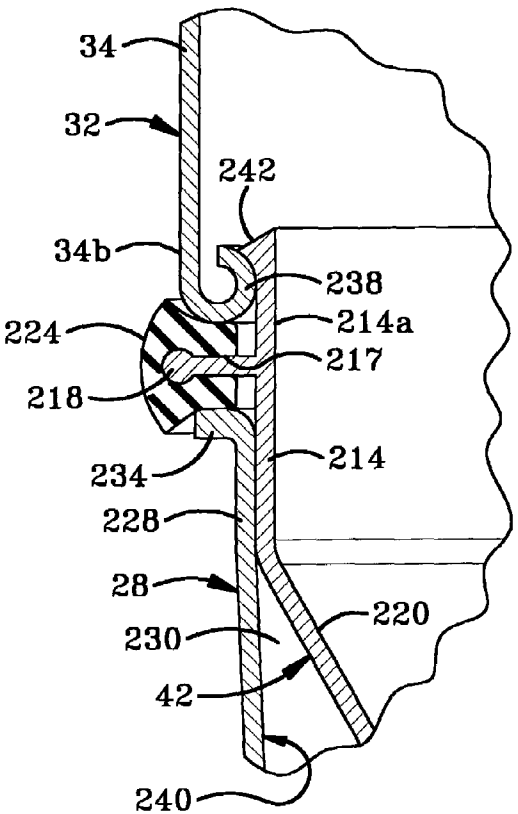
FIG-12
FIG-11
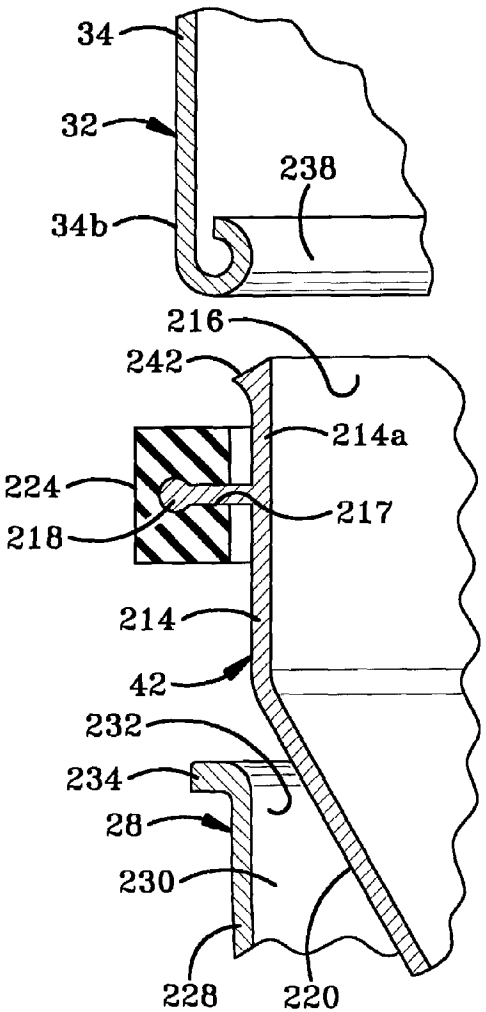

VACUUM CANISTER AND MOUNTING BRACKET FOR USE THEREWITH

BACKGROUND OF THE INVENTION

1. Technical Field

This invention generally relates to a vacuum canister for use with central vacuum systems. More particularly, the invention relates to a vacuum canister having a mounting bracket that holds various components. Specifically, the invention relates to a vacuum canister having a mounting bracket that is adapted to accept multiple size vacuum pump assemblies, has a mechanism for supporting the system's main circuit board, and has a mechanism for rapidly and easily securing and releasing the system's filter from the filter support.

2. Background Information

Central vacuum cleaner systems are common in newer homes and other buildings. These systems provide a convenient and easy way for periodically vacuuming the floors or rugs in the various rooms of a building and they eliminate the need for moving cumbersome hand-held units from room-to room.

Central vacuum systems typically include a vacuum canister, a light, portable hose, a range of vacuum cleaner attachments, a network of conduits installed in the walls and floors of the building and a number of wall-mounted receptacles. The vacuum canister is usually positioned in an out-of-the-way location in the building, such as the basement, utility room or garage.

Vacuum canisters include an electric vacuum pump assembly that is used to create the suction to draw dust-laden air through the portable vacuum hose and the rest of the central vacuum system. Canisters also include a motor for driving the pump, a filter for collecting dust entrained in the airstream, a device for collecting the entrained dust and a mechanism for circulating cleaned air back into the building.

The portable hose used with these types of systems is typically a flexible hose that includes an elongated rigid tube at one end and an end fitting at the other end. Various cleaning attachments are connectable to the elongated rigid tube and the end fitting is connectable to the conduit system through the wall receptacles.

The wall receptacles include an intake valve covered by an airtight flap or pivotable valve plate to prevent air from being unintentionally drawn into the conduit system. This maintains the vacuum state within the central vacuum system. Air enters the system only through the wall receptacle to which the portable hose is attached. The vacuum pump assembly motor is automatically turned on when the portable hose is attached to the wall receptacle.

While prior art devices have functioned in a reasonably satisfactory way, the systems have been limited inasmuch as a user has had to preselect the capacity system they need for their home or building. Smaller buildings require a smaller vacuum pump assembly to drive the system than do larger buildings. In the past, vacuum canisters have accepted only one size of vacuum pump assembly—a smaller version or a larger version. Additionally, previously known mechanisms for securing filters to vacuum systems have been difficult to use. Filters have been provided with a hole through which a long threaded rod has had to be inserted, with the user having to thread the rod into the hole with the filter blocking the user's vision. Furthermore, previously known systems have used a funnel for directing dust from the dust-collection chamber into a collection bin for disposal. The funnels have merely rested on the top of the collection bins. Consequently, every time the user wishes to empty the bin, the funnel has to be placed on a surface in the building so that the bin could be emptied. When the funnel is put down on the surface, loose dust that has remained on the funnel tends to drop on the surface, thereby creating an immediate need for vacuuming the same up once the system is reassembled.

Various types of vacuum canisters have been devised to separate dirt from the dirt-laden air vacuumed from the rooms of a building. One common design utilizes a cylindrical filter similar to an elongate version of those used in automobiles for years. The design has a pleated filter body capped by respective rubber end rings. The filter is disposed in a lower dirt-collecting portion of the vacuum canister to filter our dirt particles prior to passing through a suction pump driven by an electric motor. Alternatively, a filter bag may be placed over a cylindrical ribbed structure to filter the dirt-laden air prior to entering the vacuum pump. The pleated filter provides more surface area than the filter bag and consequently lasts longer before it becomes plugged up with dirt. With either of these filters, dirt-laden air typically enters the dirt-collecting portion of the canister through an air inlet that is disposed so as to allow the incoming air to perpendicularly strike the air filter. This may cause premature clogging of the filter with dirt since both the larger and smaller dust particles may be retained by the air filter. A more desirable situation is for the larger dust particles to fall immediately to the bottom of the canister and into the collection bin.

Another common design for vacuum canisters, is the cyclonic separator in which the air inlet is disposed tangentially to the filter so that the air travels along a curved interior surface of a cylindrical separation chamber. A curved "skirt" hangs down from an upper end of the separation chamber so as to aid in directing the incoming dirt-laden air between an interior surface of the separation chamber and an exterior surface of the skirt. The dirt-laden air flows downwardly in a spiral motion within the separation chamber and, as it does this, the larger particles drop out of the moving air for collection. Once the flow of air reaches a bottom portion of the separation chamber, the airflow changes direction and spirals upwardly within a vortex created by the downwardly spiraling air. The flow of air is then directed from the separation chamber to an air filter that filters out the remaining dust and dirt from the airflow prior to the air entering the vacuum pump. The cyclonic separator extends the life of the air filter by preventing premature clogging with particles that are large enough to be removed effectively by the cyclonic action.

Various patented devices have been designed in an attempt to alleviate the shortcomings of prior art devices. For example, in U.S. Pat. No. 4,721,516, issued on Jan. 26, 1988 to Barsacq there is disclosed a central vacuum canister unit which includes three interconnected sections which form an integral vacuum canister. The vacuum canister utilizes water to filter the dirt-laden air. A top section of the canister contains a suction turbine, a motor and an exhaust outlet for clean air. A center section contains air baffles, a perforated circular conduit below the air baffles for dispersing the water, an angled inlet conduit for dust-laden air, and a water level sensor. A bottom section contains a water outlet, a flexible sleeve valve, an outlet end of the angled inlet conduit from the center section, a water reservoir filled with water to a level above the outlet end of the inlet conduit—even with the water outlet, and a drain plug. The dirt-laden air bubbles through water in the reservoir, which water is automatically flushed by electronic control circuitry coordinating a filling and evacuation sequence of the reservoir.

In U.S. Pat. No. 4,944,780, issued on Jul. 31, 1990 to Usmani, there is disclosed a vacuum canister comprising four detachable subassemblies and a detachable filter assembly. A first subassembly comprises a vacuum motor and exhaust housing having an inlet opening at one end for admitting dirt-laden air that is drawn into the housing by the vacuum motor. A second subassembly comprises a housing adapted to be secured to a wall to support the vacuum canister as installed. This housing houses a vacuum cleaner inlet. A cyclonic flow of air is created in the housing during operation of the vacuum motor. A third subassembly comprises a dirt collecting housing for receiving and holding dirt particles released by the cyclonic air flow. A fourth subassembly comprises a base plate adapted to be secured in a fixed relationship with the first subassembly and the second subassembly. A hole through the base plate permits a flow of air between the first and second subassemblies. A bracket, adapted to removably secure an air filter, includes a device that engages the base plate such that the air filter is secured thereon in proper filtering relation between the first and second subassemblies.

There is therefore a need in the art for providing a mechanism for providing a convenient, cost effective, safe vacuum unit having the features of being able to selectively mount vacuum pump assemblies and circuit boards of different types, of having a quick and easy mechanism for attaching and detaching the system filter and for preventing the need to lay the dust-laden funnel in the vicinity of the vacuum canister when the user is emptying the collection bin.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

FIG. 11 is a fragmentary exploded view in longitudinal vertical section of the interconnection of a housing, a dirt removal bucket, and a funnel assembly.

FIG. 12 is a fragmentary view in longitudinal vertical section corresponding to FIG. 11;

Similar numerals refer to similar parts throughout the drawings.

DETAILED DESCRIPTION OF THE INVENTION

Figure 1:
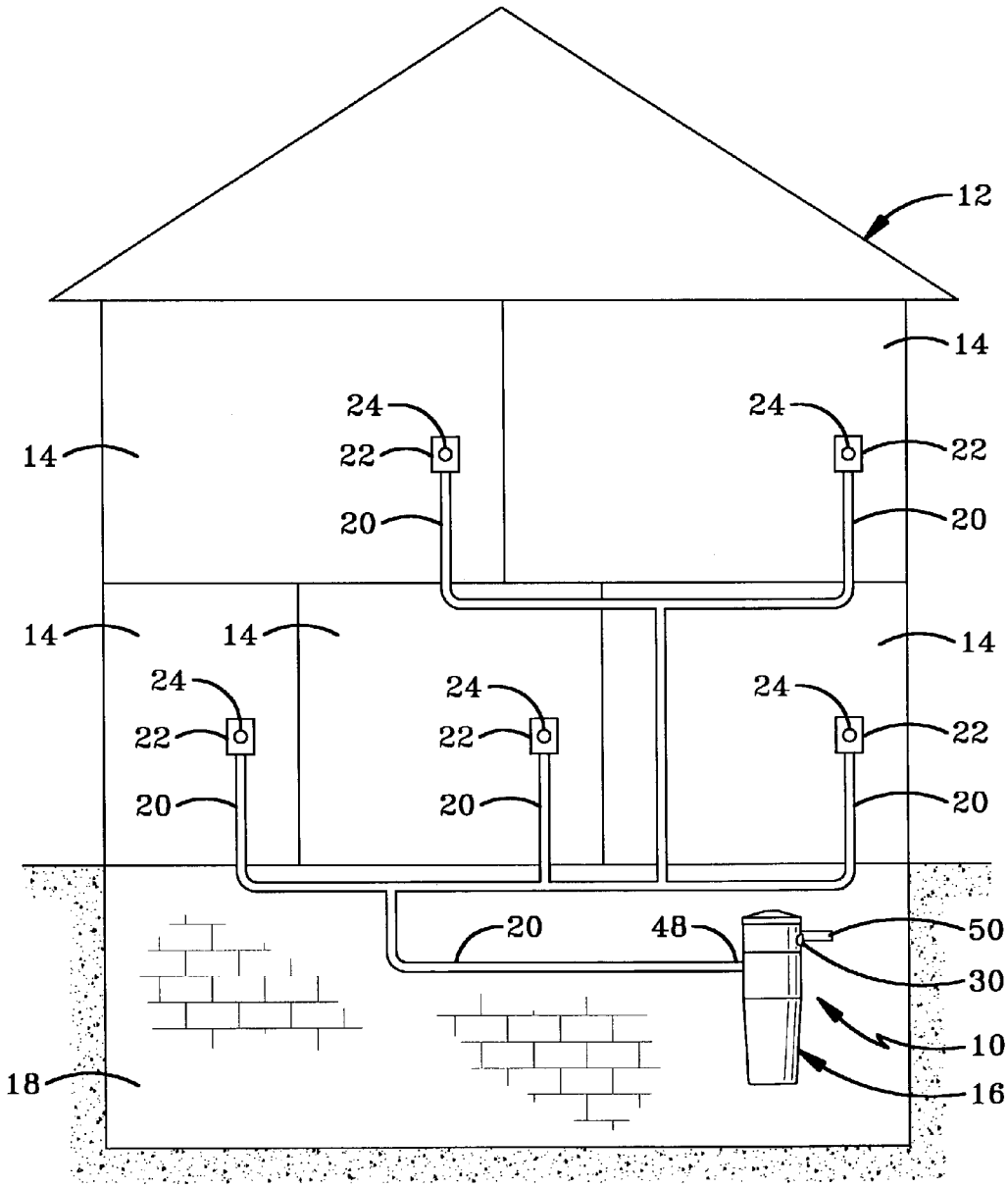
FIG. 1 is a diagrammatic view in of a house having a central vacuum system which utilizes the vacuum unit of the present invention.

Referring to FIG. 1 there is shown a central vacuum system, generally referenced by the number 10, installed in a house 12 that has a plurality of rooms 14. System 10 includes a vacuum canister 16 which is preferably located in a less-used area of house 12, such as the basement 18. A series of conduits 20 connect vacuum canister 16 to a plurality of intake valves or receptacles 22, each of which is preferably located in a separate room 14 in house 12. Each receptacle 22 includes a vacuum opening 24 that is adapted to receive an end fitting (not shown) of a flexible hose (not shown). Each receptacle 22 is covered by a flap or pivotal plate (not shown) to prevent air from flowing into receptacle 22 when the flexible hose is not connected thereto. Basement 18 does not have a receptacle 22 and this room is serviced by the provision of an auxiliary vacuum intake assembly 30 on vacuum canister 16 itself.

Figures 2, 3:
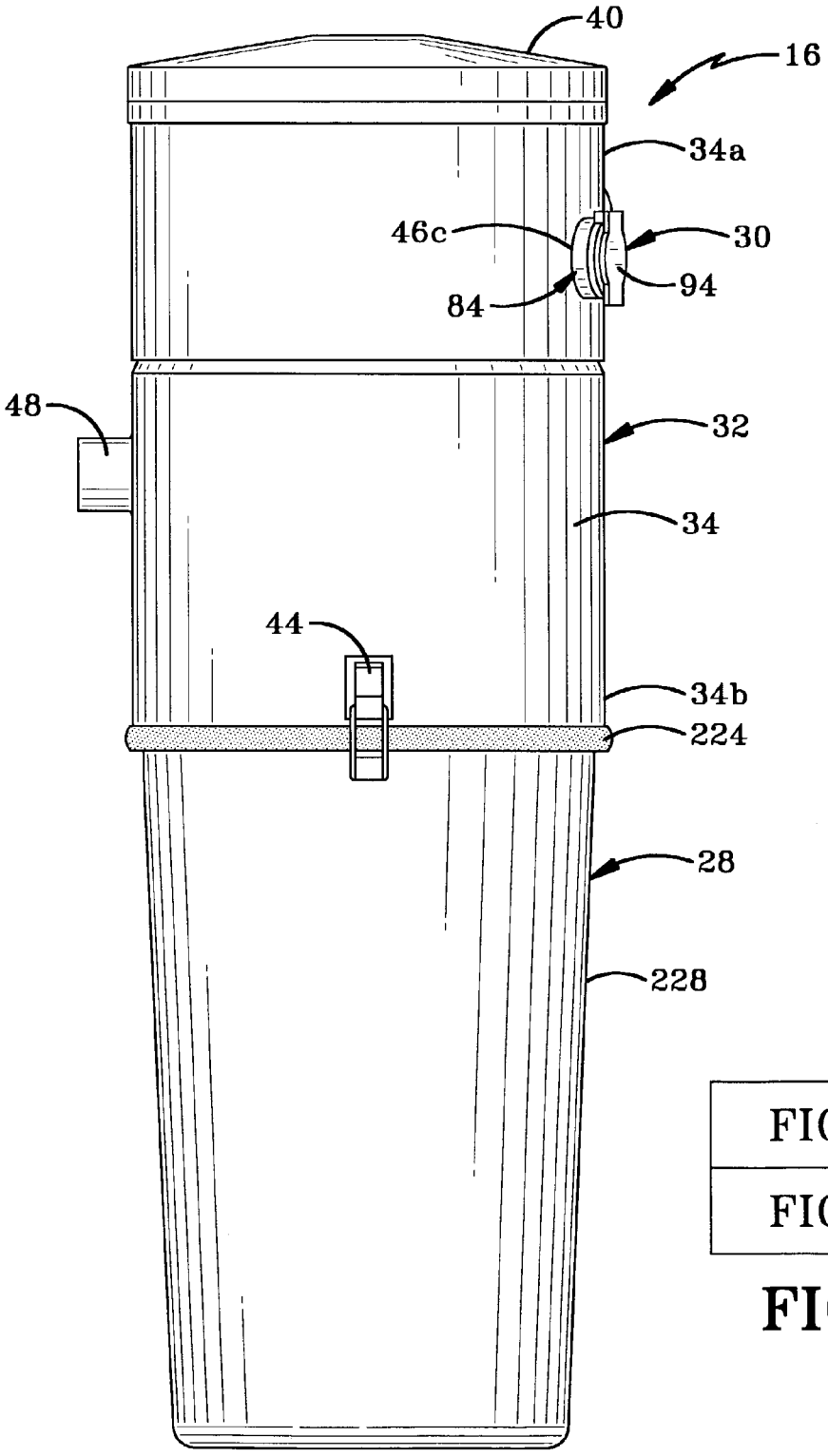
FIG. 2 is a side elevational view of the vacuum unit of FIG. 1.
Figure 4:
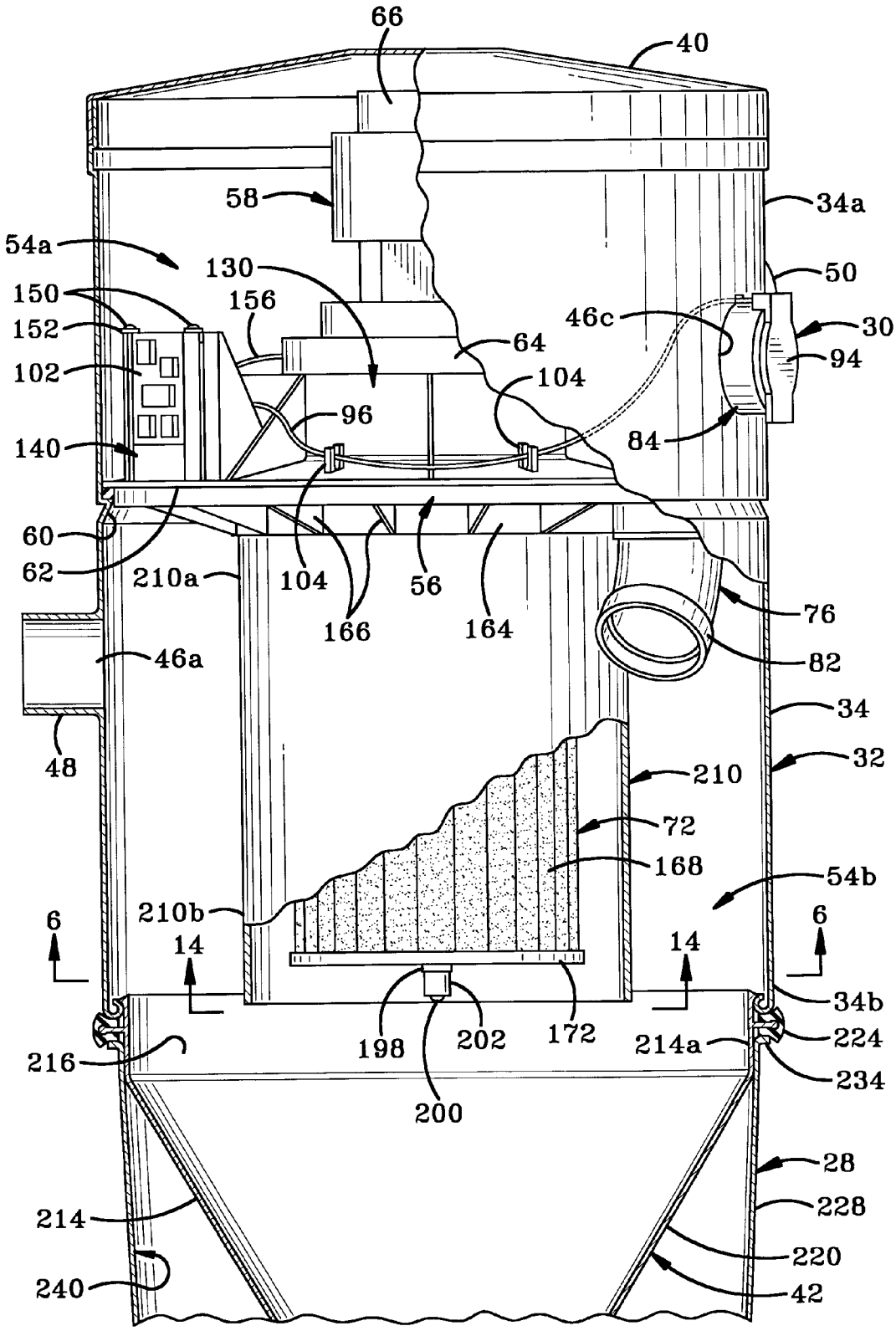
FIG. 4 is a fragmentary cross-sectional side view of the vacuum unit of the vacuum unit of FIG. 1.
Figure 5:
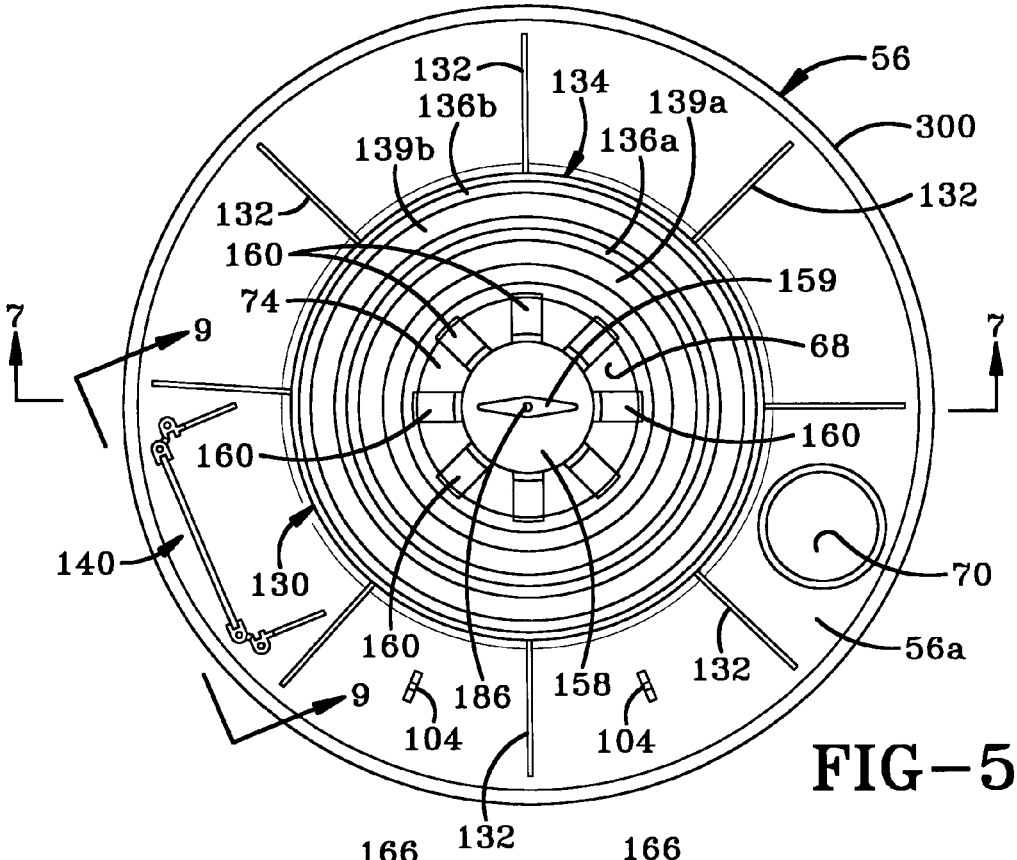
FIG. 5 is a top plan view of a mounting bracket of the vacuum canister.
Figure 6:
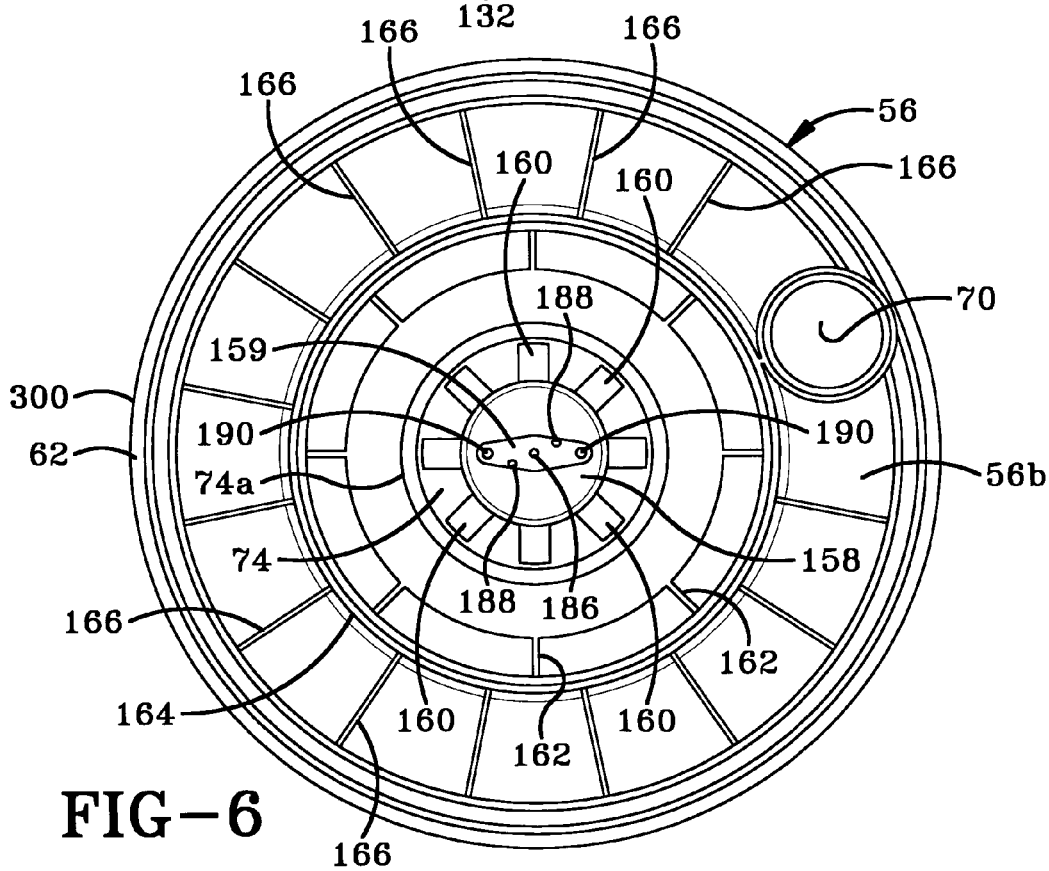
FIG. 6 is a bottom plan view of the mounting bracket of the vacuum canister.
Figure 5A:
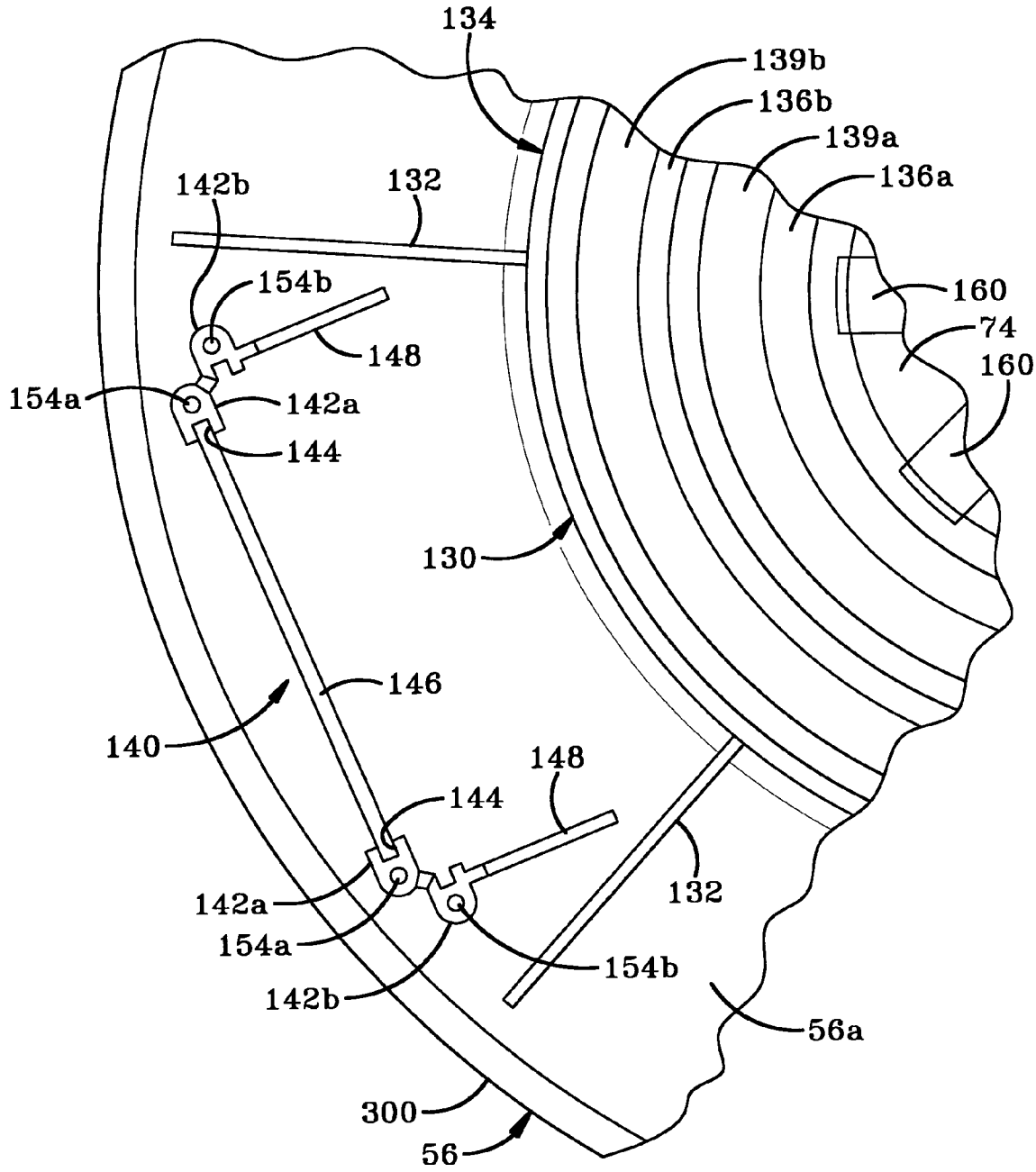
FIG. 5A is a fragmentary top plan view of the mounting bracket showing an upright bracket for mounting a main control circuit board.
Figure 7:
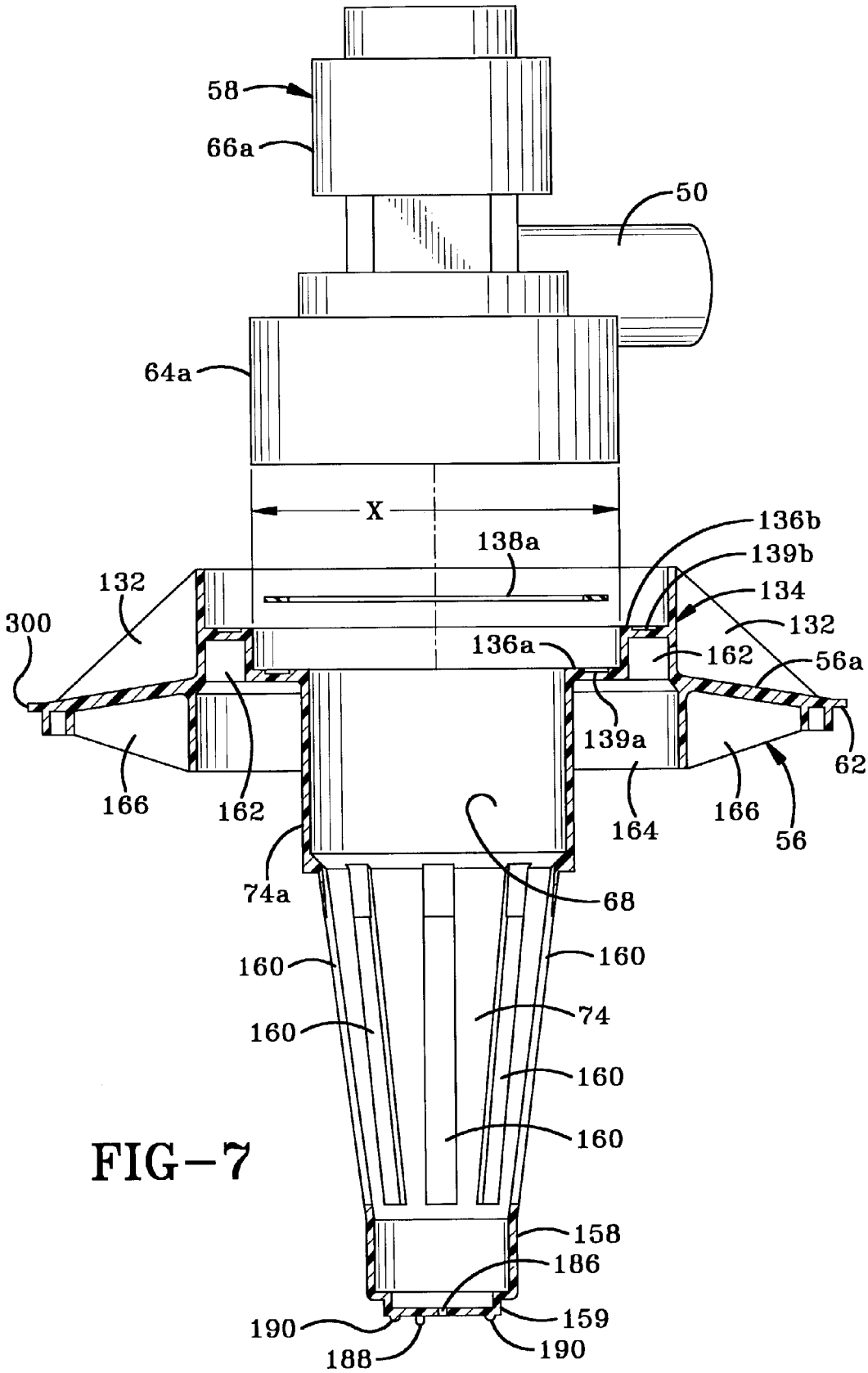
FIG. 7 is an exploded view of a mounting bracket, a small pump assembly and a small gasket in partial longitudinal vertical section taken along line 7—7, FIG. 5.

Referring to FIGS. 2–4 there is shown a vacuum canister 16 in accordance with the present invention. Vacuum canister 16 includes a substantially hollow housing, generally referred to by the number 32. Housing 32 is generally cylindrical in shape and has a wall 34 having an upper end 34*a* and a lower end 34*b*. Upper end 34*a* defines a first opening 36 and lower end 34*b* defines a second opening 38. First opening 36 is covered by a removable cover 40. A funnel 42 is disposed beneath second opening 38 and funnel 42 directs the collected dust into a dust collection bin 28 disposed beneath funnel 42. Collection bin 28 is preferably releasably secured to the lower end 34*b* of housing 32 by way of a plurality of latches 44 or other suitable means. Wall 34 defines three holes 46*a*, 46*b*, 46*c* for receiving various pipes into vacuum canister 16. First hole 46*a* receives a suction intake pipe 48 that is connected to conduits 20. Second hole 46*b* receives an exhaust pipe 50 for exhausting air back into house 12. Third hole 46*c* receives an auxiliary vacuum intake assembly 30 for connecting a portable vacuum hose (not shown) thereto. Housing 32 is internally divided into an upper or clean chamber 54*a* and a lower or dirt collection chamber 54*b* by a mounting plate or bracket 56. First hole 46*a* is positioned so that suction intake pipe 48 enters dirt collection chamber 54*b*, while second hole 46*b* and third hole 46*c* are positioned so that exhaust pipe 50 and auxiliary vacuum intake assembly 30 enter clean chamber 54*a*.

In accordance with the present invention, a mounting bracket 56 is provided that separates housing 32 into clean and dirt collection chambers 54*a*, 54*b*, and that supports a vacuum pump assembly 58 and a filter 72. Mounting bracket 56 has a body that is preferably a single, integral structure that is molded from plastic or some other suitable material. Mounting bracket 56 may, however, be made as more than one component without departing from the scope of this invention. Mounting bracket 56 may be generally circular in shape so as to be configured to fit within housing 32. However, if the housing is manufactured with some other cross-sectional shape, such as square or rectangular, a mounting bracket of similar cross-sectional shape may be used without departing from the spirit of the present invention. While the following description refers to the circular version of the mounting bracket 56, it will be understood by those skilled in the art that similar structures would be desirable on mounting brackets of other shapes.

Referring to FIGS. 3A, 4–8, it may be seen that mounting bracket 56 has an upper surface 56*a* and a lower surface 56*b* and defines both a centrally located bore 68 and an aperture 70. Mounting bracket 56 has a radially-ribbed central portion 130, having a plurality of ribs 132 radiating outwardly from an area a spaced distance from bore 68 towards the outer perimeter 300 of mounting bracket 56. Ribs 132 provide strength and rigidity to mounting bracket 56. Both bore 68 and aperture 70 connect clean chamber 54*a* to dirt collection chamber 54*b*. Mounting bracket 56 is of a slightly smaller diameter than the internal diameter of housing 32. An inwardly disposed, annular ledge 60 is provided on housing wall 34 for supporting mounting bracket 56. An annular lip 62 is formed on lower surface 56*b* of mounting bracket 56, and annular lip 62 is adapted to rest on annular ledge 60 when mounting bracket 56 is positioned inside housing 32.

Figure 8:
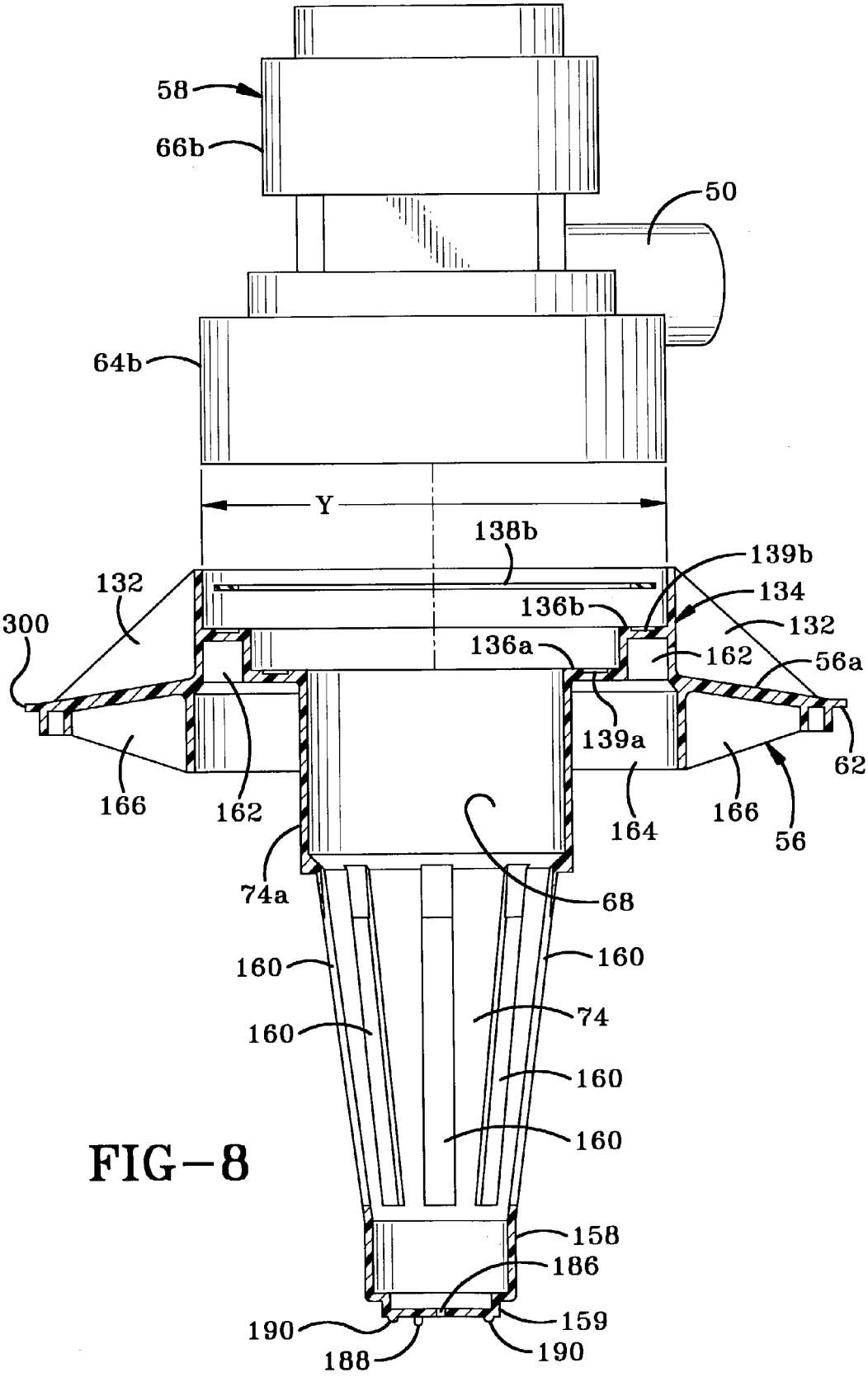
FIG. 8 is an exploded view of the mounting bracket, a large pump assembly, and a large gasket in partial longitudinal vertical cross-section

Referring to FIGS. 5–8, upper surface 56*a* of mounting bracket 56 is adapted to support a vacuum pump assembly 58 that includes an AC (alternating current) motor 64 for driving a vacuum pump 66. Upper surface 56*a* includes a motor mounting area 134 that is molded with at least one, and preferably two stepped, annular ledges 136. First ledge 136*a* and second ledge 136*b* have different diameters so as to enable one of two different size motors 64*a*, 64*b*, and therefore one of two different size vacuum pump assemblies 66*a*, 66*b*, to be individually supported by mounting bracket 56. Diameter X of small motor 64*a* (FIG. 7) is smaller than diameter Y of larger motor 64b (FIG. 8). A small motor 64*a* may be supported by smaller first ledge 136*a* (FIG. 7) or a larger motor 66*b* may be supported by larger second ledge 136*b* (FIG. 8). Respective large and small air seal gaskets 138*a*, 138*b* are received in the respective grooves 139*a*, 139*b*. Gasket 138*a* is positionable in first groove 139*a* and gasket 138*b* is positionable in second groove 139*b*. Clean chamber 54*a* is a dust-free zone while dirt collection chamber 54*b* is a dust-laden zone. Vacuum pump 66 and motor 64 are mounted on mounting bracket 56 in such a manner that they lie entirely or mainly in the dust-free zone of clean chamber 54*a*. This aids in preventing the dust in the vacuum system 10 from damaging vacuum pump assembly 58.

Referring to FIGS. 5, 5A, 9 and 10, upper surface 56*a* of motor mounting bracket 56 also includes at least one, and preferably two, upwardly extending circuit board brackets, generally referred to by the number 140. Each circuit board bracket 140 comprises a pair of spaced apart, upwardly extending first supports 142 each defining a slit 144 therein. First supports 142 extend at generally ninety-degrees to upper surface 56*a*. Slits 144 are inwardly-facing for each pair of circuit board supports 142 and are adapted to slidingly receive circuit board 102 therebetween. As may be seen from FIG. 5A, a first circuit board bracket has first supports 142*a* spaced closer to each other than the second supports 142*b* of second circuit board bracket. Second supports 142*b* extends at generally ninety-degrees upper surface 56*a*. This allows differently sized circuit boards to be slidably installed on mounting bracket 56. First circuit board bracket includes a stop member 146 to retain a lower edge 102*b* of circuit board 102. Stop member 146 acts as a stiffener for first circuit board bracket. Second circuit board bracket includes a gusset 148 to strengthen each support 142*b* to prevent damage to the same when circuit 102 is installed therein. If a larger motor 64*b* is being installed into second ledge 136*b*, a larger circuit (not shown) may be installed into second circuit board bracket. If a smaller motor 64*a* is being installed into first ledge 136*a*, then a smaller circuit board 102 may be installed into first circuit board bracket 140*a*. The user may therefore use the same housing 32 to accomadate two differently sized cental vacuum systems 10 by utilizing two differently sized motors 64 and circuit boards 102. This reduces production costs for such systems and reduces the number of parts installers need to carry with them.

Figure 9:
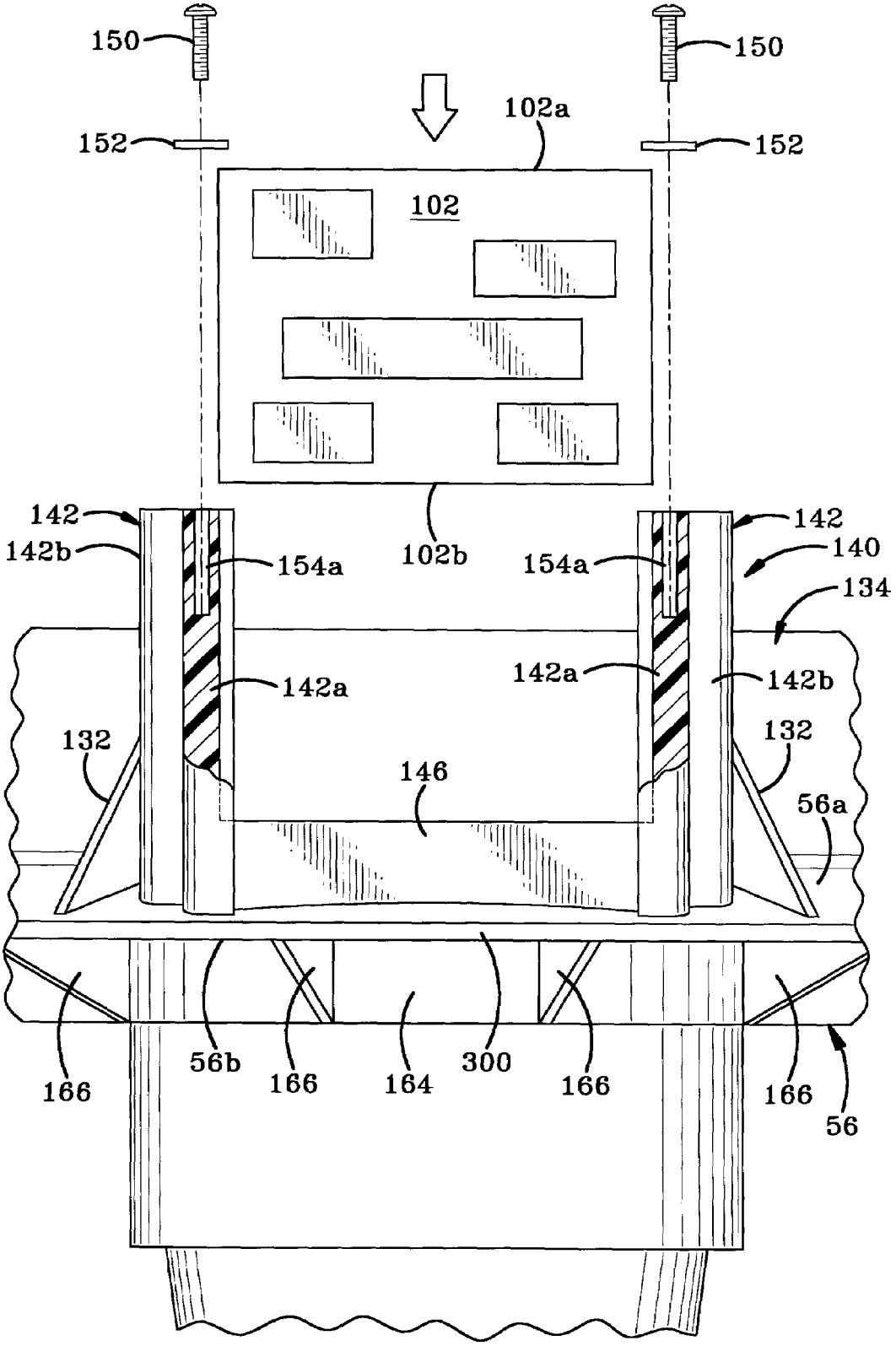
FIG. 9 is a fragmentary exploded view of the mounting bracket, the main control circuit board, and mounting hardware taken along 9—9 FIG. 5, with the upright bracket partially broken away.
Figure 10:
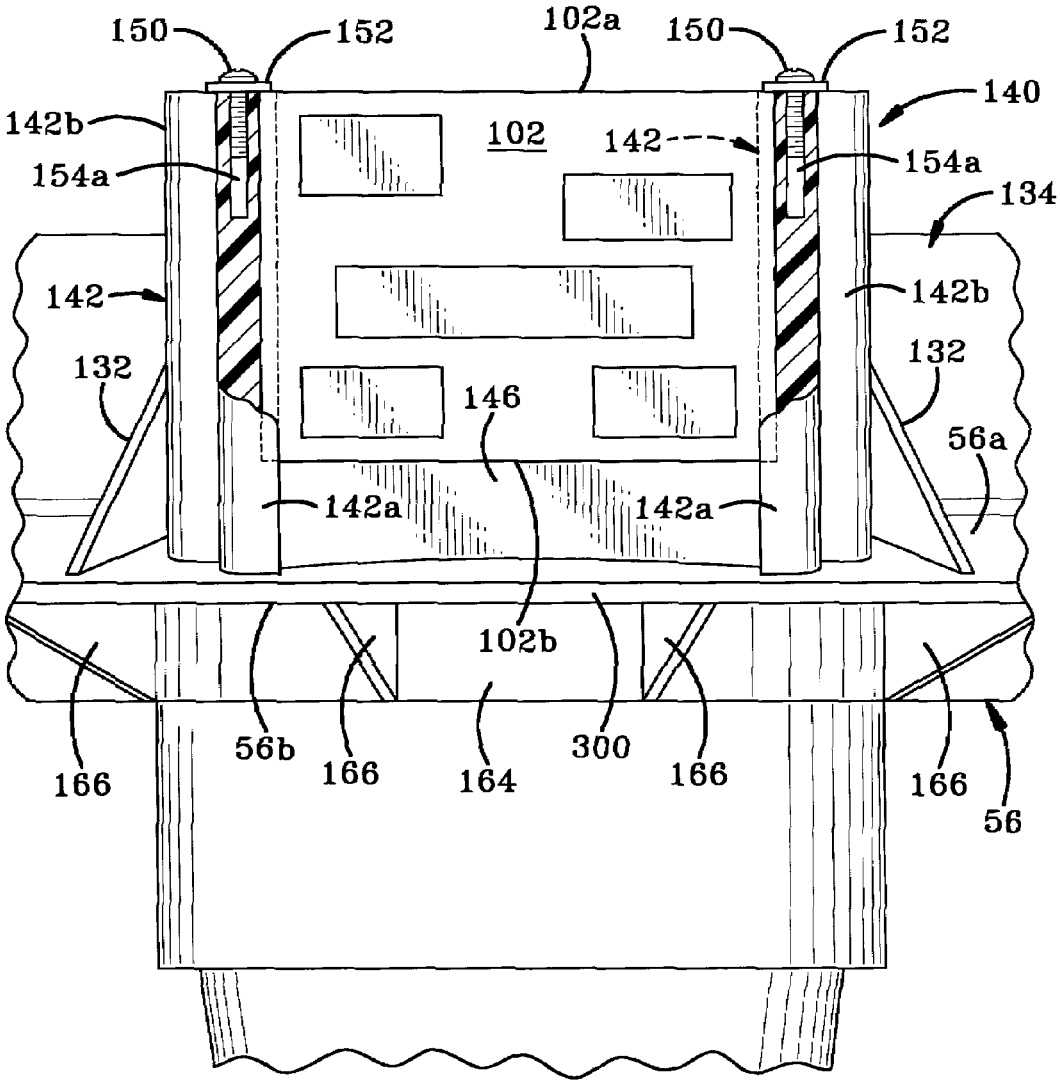
FIG. 10 is a fragmentary view of the mounting bracket, the main control circuit board, and mounting hardware corresponding to FIG. 9.

Additionally, the installation of a circuit board was previously an eleven-piece assembly process for installers. With the provision of the circuit board bracket 140 on mounting bracket 56, a circuit board 102 may simply be slid into slits l44. A screw 150 may be screwed through washer 152 and into one of the apertures 154*a* in first circuit board bracket 140 to keep circuit board 102 in place. A second screw 150 may be screwed into the second aperture 154*a* of first circuit board bracket as is shown in FIG. 9. If a larger circuit board (not shown) is installed into second circuit board bracket, screws may be screwed into apertures 154*b* in supports 142*b*. While screws 150 are used in this instance, pins, caps or any other suitable means may be used to secure a circuit board 102 in a circuit board bracket 140. The means to secure the board in place must simply provide a way for locking the upper edge 102*a* of circuit board 102 in place in circuit board bracket 140. A sheathed electrical cable 156 is used to connect circuit board 102 to motor 64 (FIG. 4). A second electrical cable 96 is used to connect circuit board 102 to auxiliary intake valve assembly 30. Snap clips 104 secure cable 96 to upper surface 56*b* of mounting bracket 56.

Referring to FIG. 3A, 7, 8, 13–15, lower surface 56*b* of mounting bracket 56 includes a centrally located filter support 74 that is adapted to extend from lower surface 56*b* and into dirt collection chamber 54*b* when mounting bracket 56 is positioned in housing 32. Filter support 74 is preferably molded as an integral part of mounting bracket 56. Filter support 74 is frusto-conical in shape with its greatest diameter being proximate lower surface 56*b* and its smallest diameter being a spaced distance from lower surface 56*b*. Filter support 74 tapers to an end cap 158. End cap 158 includes a mounting post 159 that is adapted to engage filter 72. Mounting post 159 includes a pair of lock posts 188 and a pair of round-ended release posts 190 that extend downwardly therefrom. Upper end 74*a* of filter support 74 is concentric with bore 68 that extends through mounting bracket 56. Filter support is hollow and defines a plurality of slots 160 through which air may flow into bore 68 and upwardly into clean chamber 54*a* of housing 32. Slots 160 are shown as being longitudinal in orientation, but any suitable pattern or orientation of slots 160 may be used without departing from the scope this invention. A plurality of stiffeners 162 are provided in lower surface 56*b* in a concentric ring around upper end 74*a* of filter support 74. A filter-receiving ring 164 is disposed around filter support 74 and lies a spaced distance therefrom. A concentric ring of second ribs 166 radiate outwardly from ring 164 toward perimeter 300 of mounting bracket 56. Aperture 70 extends through mounting bracket 56 within this concentric ring of second ribs 166. Annular lip 62 is disposed outwardly of concentric ring of second ribs 166.

Figure 13:
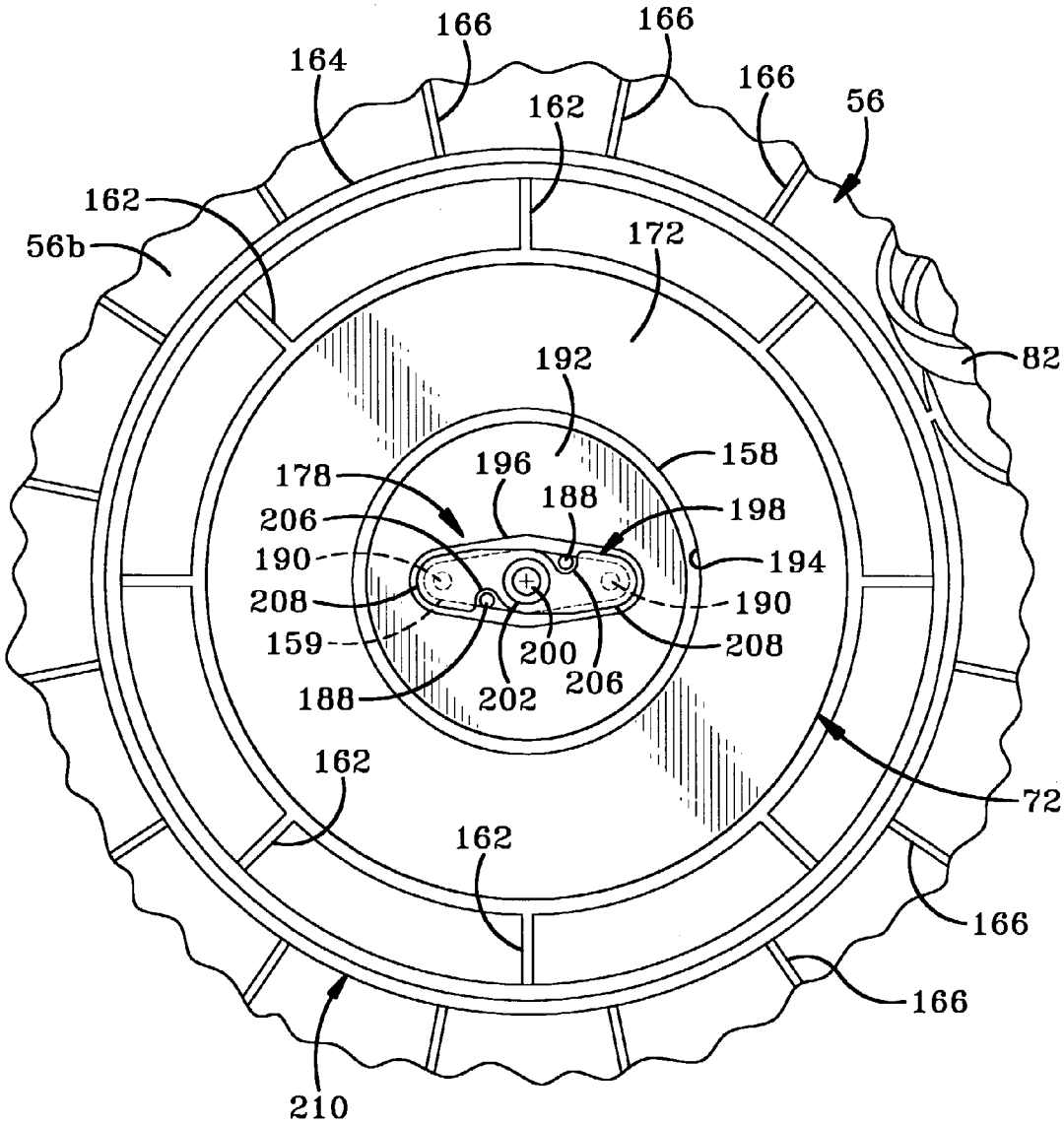
FIG. 13 is a lateral horizontal sectional view of a deflector filter assembly mounted to the mounting bracket, including an air filter and a quick release device, with a locking member for the quick release device shown in a released position.
Figure 14:
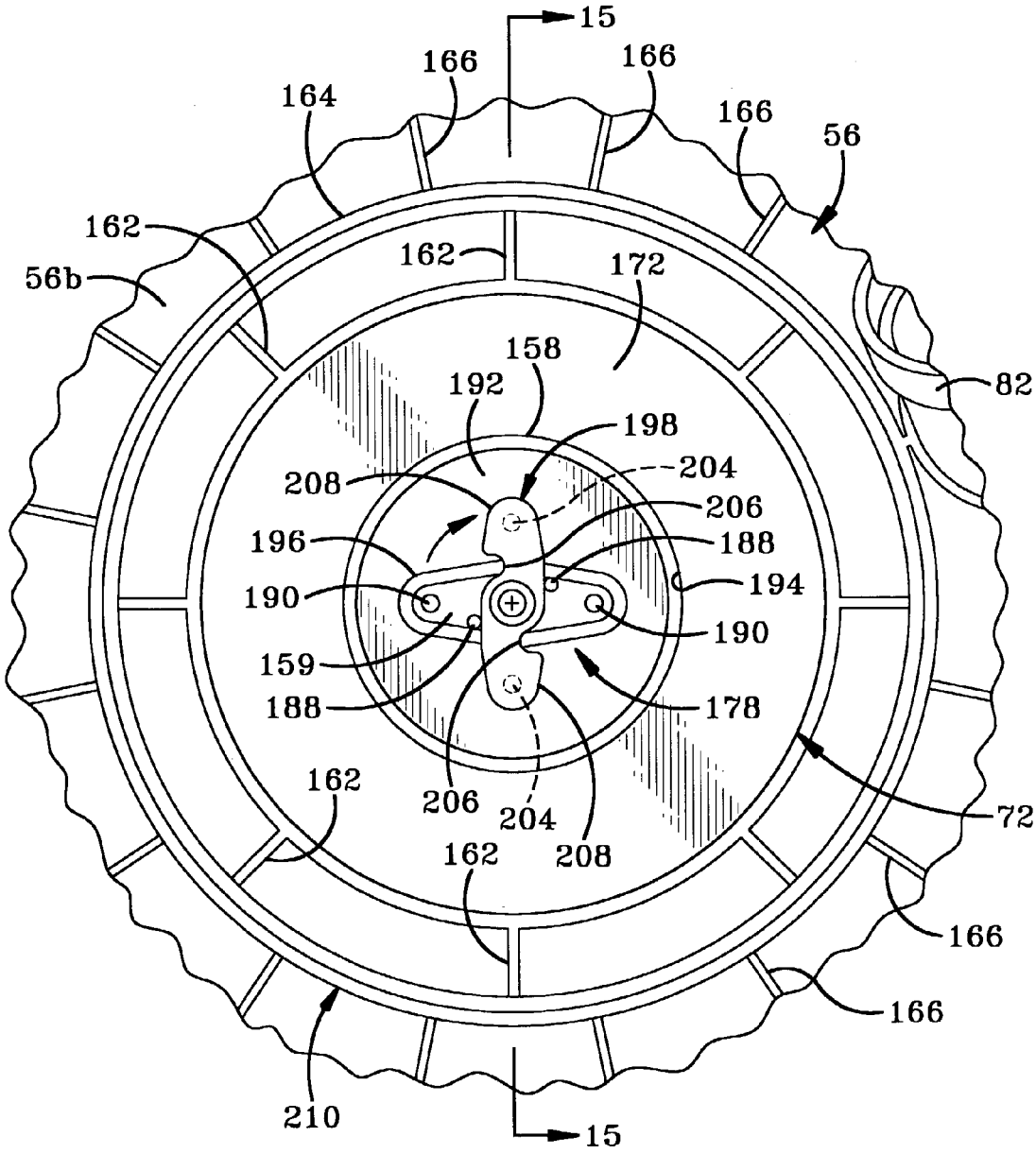
FIG. 14 is a lateral horizontal sectional view of the filter assembly and the quick release device taken along line 14—14, FIG. 4, corresponding to FIG. 13, but with the locking member in a locked position.
Figure 15:
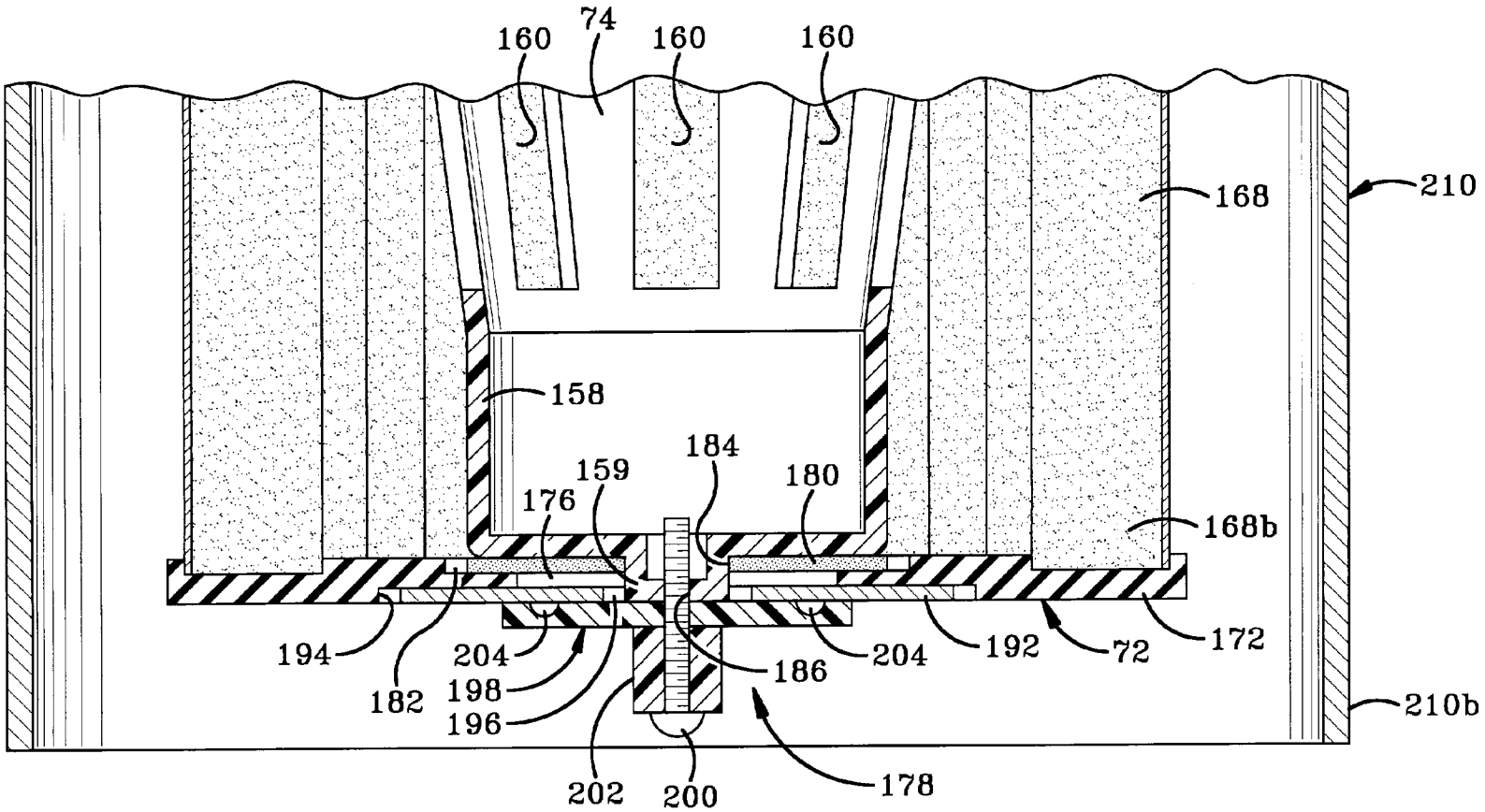
FIG. 15 is a fragmentary longitudinal sectional view of the filter assembly and the quick release device taken along line 15—15, FIG. 14.

Referring to FIGS. 3B, 4, 13–15, an air filter 72 is attached to filter support 74 to filter the dirt-laden air that enters dirt collection chamber 54*b*. Air filter 72 is a generally cylindrical body that is made of filter material 168 that is sandwiched between an upper sealing band 170 and lower sealing band 172. Upper sealing band 170 extends across the upper end 168*a* of the filter material 168 and upper sealing band 170 defines a central hole 174 through which filter support 74 is inserted. Lower sealing band 172 extends across the lower end 168*b* of filter material 168. Lower sealing band 172 engages end cap 158 of filter support 74 and lower sealing band 172 defines an aperture 176 that is configured to be slightly smaller than end cap 158 of filter support 74. Filter 72 is disposed in a spaced relation about filter support 74 using a quick release mechanism generally referred to by the number 178. Quick release mechanism 178 includes a small flat washer 180 that lies in contact with end cap 158 in a first annular recess 182 of lower sealing band 172. Washer 180 has an oblong hole 184 adapted to receive mounting post 159 of end cap 158 therethrough. A larger flat washer 192 is disposed in a second annular recess 194 of lower sealing band 172. Large washer 192 defines an oblong hole 196, of a slightly larger size than hole 184 of small washer 180, and this larger hole 196 is adapted to receive a locking member 198 therethrough. Locking member 198 is pivotally mounted to end cap 158 using a screw 200 and tubular spacer 202. Screw 200 threadably engages mounting post 159, screw 200 being receivable into aperture 186 in mounting post 159. Locking member 198 includes a pair of detents 204 adapted to engage release posts 190 to hold locking member 198 in a released position (FIG. 13). Locking member 198 further includes a pair of opposing slots 206 adapted to clear lock posts 188 in the released position of locked member (FIG. 13). A pair of opposing edges 208 engage lock posts 188 when locking member 198 is in the locked position (FIG. 14). Locking member 198 holds filter 72 to filter support 74 when locking member 198 is in the locked position transverse to holes 184, 196. Locking member 198 may pass through holes 184, 196 when in the released position when filter 72 is being either removed from or installed onto filter support 74.

Figure 3A:
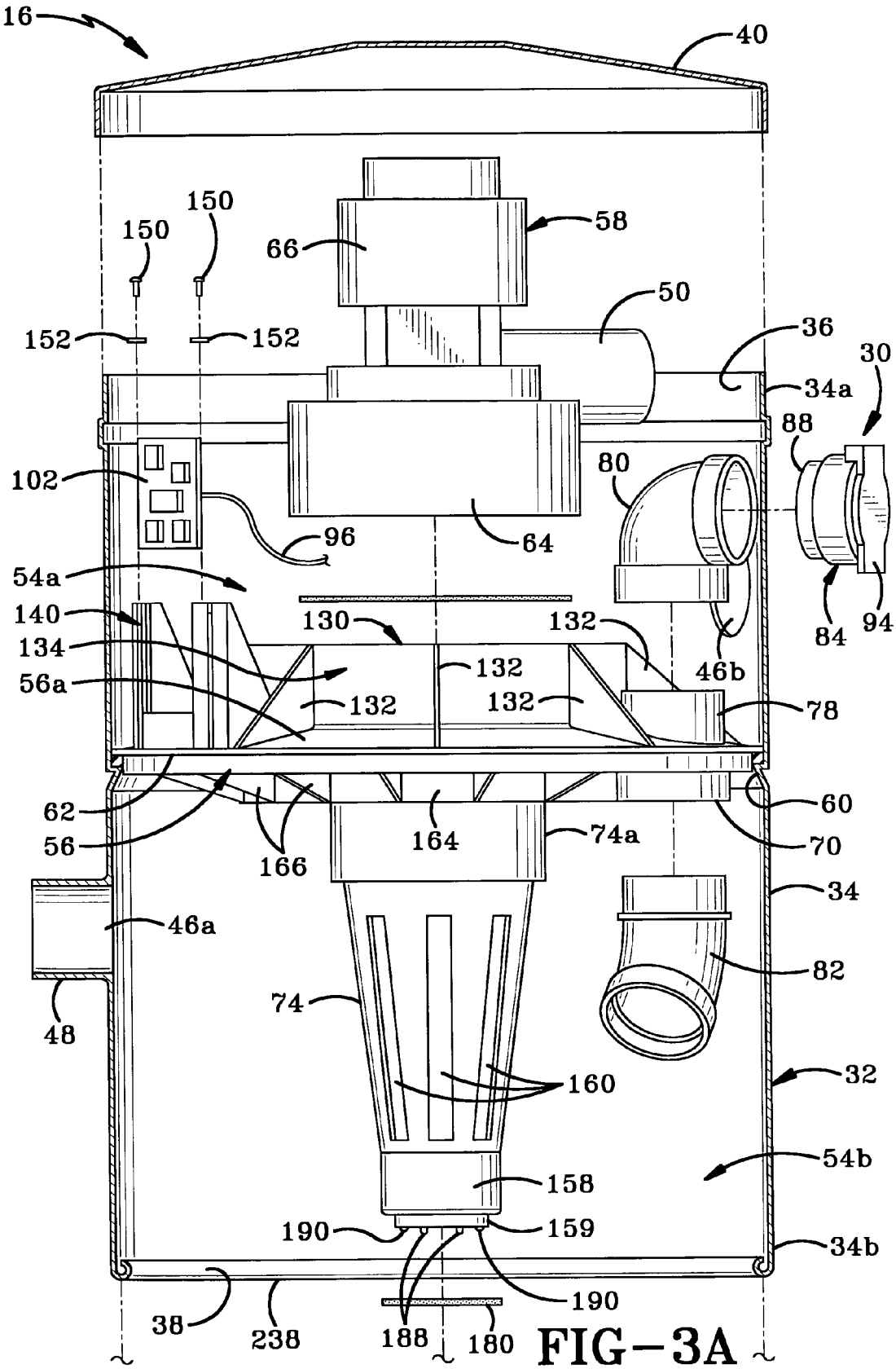
FIG. 3A is a partially exploded cross-sectional side view of the upper portion of the vacuum unit of FIG. 1.
Figure 3B:
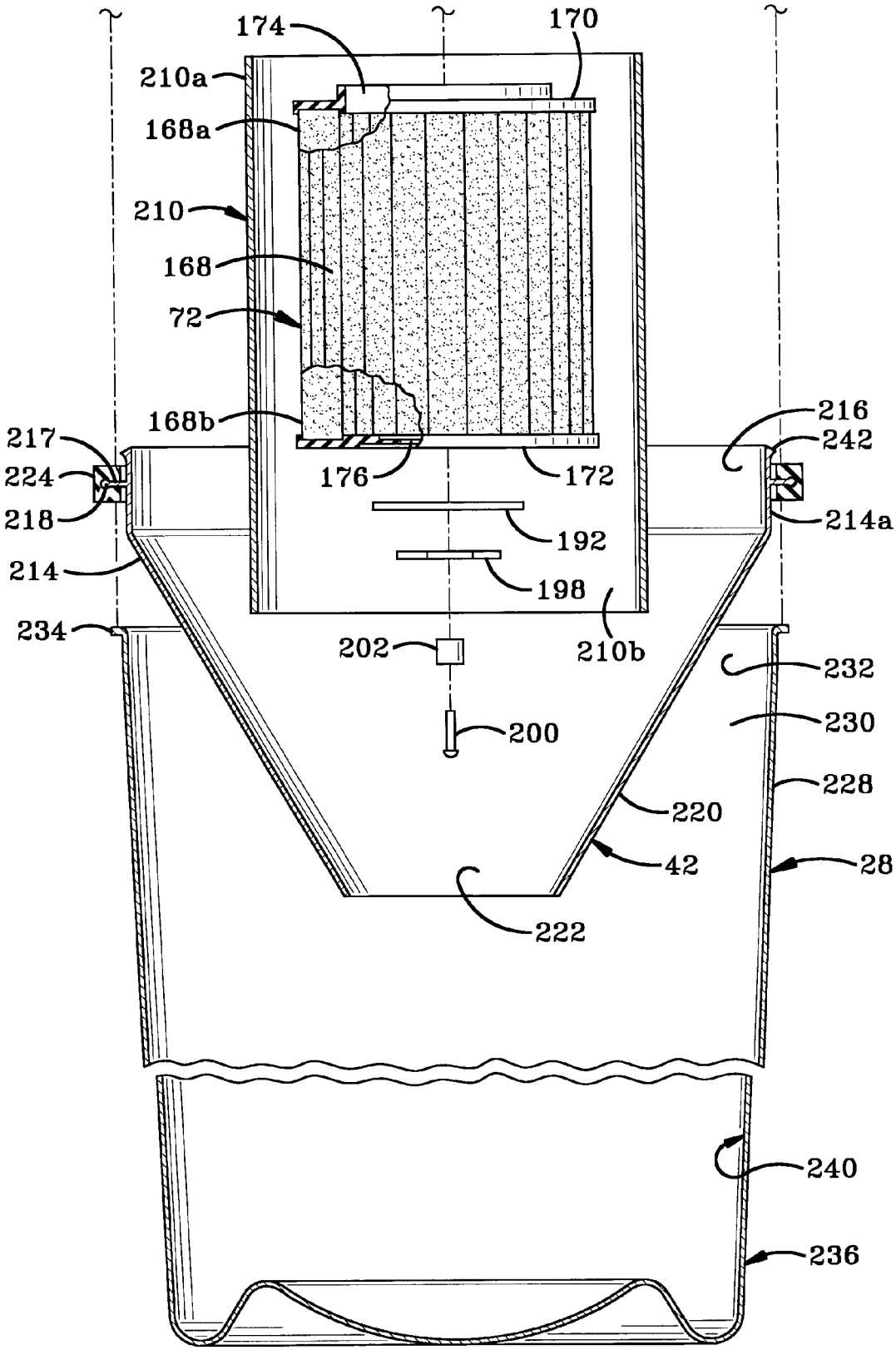
FIG. 3B is a partially exploded cross-sectional side view of the lower portion of the vacuum unit of FIG. 1.

Referring to FIGS. 3B and 4, it may be seen that vacuum canister 16 further includes an air deflector tube 210 adapted to be disposed in a spaced relationship around filter 72. Deflector tube 210 has a first end 210*a* secured such as by press-fitting within downwardly disposed ring 164 of mounting bracket 56. A second end 210*b* of tube 210 extends below suction intake pipe 48 so that dust received through pipe 48 into dirt collection chamber 54*b* does not directly impact filter 72. This allows heavier dust particles to drop directly into funnel 42 rather than being sucked against air filter 72. This arrangement assists in extending the life of filter 72. Dust-laden air from house 12 is suctioned into dirt collection chamber 54*b* through suction intake pipe 48, strikes air deflector 210, swirls around filter 72, is sucked through filter 72 and into the air stream that travels upwardly through bore 68 and into clean chamber 54*a*. Cleaned air from clean chamber 54*a* is exhausted into house 12 through exhaust pipe 50.

Referring to FIGS. 3B, 4, 11 and 12, funnel 42 comprises an outerwall 214 that forms a parallel-walled upper portion 214*a* that has a large inlet opening 216, an outwardly extending radial flange 218 and a downwardly dependent cone portion 220 that terminates at a small outlet opening 222. Funnel 42 further includes a resilient annular seal 224 of generally rectangular cross-section. Seal 224 includes an annular slot 217 that is adapted to engage the radial flange 218. Seal 224 may be manufactured from a closed-cell polyurethane foam or other such material that is compressible to form a seal. Upper edge of funnel 42 is formed into a lip 242.

Collection bin 28 has an outer wall 228 that forms a parallel-walled main portion 230 with an upper opening 232 at a radially outwardly disposed flange 234 adapted to interface with housing 32. Main portion 230 has a closed lower portion 236. Funnel 42 and bin 28 connect to housing 32 through the resilient annular seal 224 that engages the sealing edge 238 of housing 32 and the radial flange 234 of bin 28. This prevents leakage of air into an elongate chamber 240 formed thereby. Latches 44 retain housing 32 to collection bin 28 with the funnel 42 locked there between. Lip 242 of funnel 42 engages with sealing edge 238 of housing 32 so that when collection bin 28 is removed from vacuum canister 16, funnel 16 remains attached to sealing edge 238 of housing 32.

Referring to FIG. 3A, mounting bracket 56 also defines an aperture 70 through which an auxiliary vacuum intake assembly 30 is connected to dirt collection chamber 54*b*. Auxiliary vacuum intake assembly 30 includes a rigid tube assembly having a short straight tube 78 which is secured within hole 46*b* of mounting bracket 56 with a ninety-degree elbow 80 and a forty-five-degree elbow 82. Straight tube 78 may be integrally molded or formed as part of mounting bracket 56. Auxiliary vacuum intake assembly 30 includes a receptacle 84 that is preferably connected electrically to motor 64. A portable vacuum hose (not shown) may be connected to receptacle 84 and dust-laden air that is suctioned into the hose is moved through auxiliary vacuum intake assembly 30 through aperture 70 and into dirt collection chamber 54*b* where it is filtered. Receptacle 84 is covered with a valve member 94 to maintain a vacuum within vacuum system 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A vacuum canister, for use in a central vacuum system, said vacuum canister comprising:

a housing having a dirt collection chamber and a clean chamber; and an integrally molded mounting bracket extending intermediate the clean chamber and the dirt collection chamber of the housing; said mounting bracket having an upper surface and a lower surface and defining a bore therethrough that connects the dirt collection chamber and the clean chamber; and wherein the mounting bracket includes a first motor-receiving groove disposed thereon.

2. The vacuum canister as defined in claim 1, wherein said first motor-receiving groove is concentric with the bore.

3. The vacuum canister as defined in claim 2, further comprising a second motor-receiving groove disposed concentrically around said bore; said first groove having a first diameter and said second groove having a second diameter; the first diameter being different to the second diameter.

4. The vacuum canister as defined in claim 3, wherein the second diameter is larger than the first diameter.

5. The vacuum canister as defined in claim 4, wherein said second groove lies in vertical stepped relation to said first groove.

6. The vacuum canister as defined in claim 3, wherein said mounting bracket is molded and said first and second grooves are integrally molded with said mounting bracket.

7. The vacuum canister as defined in claim 3, wherein said mounting bracket has an outer perimeter that is adapted to abut said housing and said mounting bracket further comprises:

a ring of horizontally spaced-apart ribs disposed about said second groove, said ribs radiating outwardly from said second groove toward the outer perimeter of said mounting bracket.

8. The vacuum canister as defined in claim 1, further comprising a first circuit board bracket mounted on the upper surface of said mounting bracket.

9. The vacuum canister as defined in claim 8, wherein said first circuit board bracket comprises a pair of spaced-apart upright first supports, each first support extending at generally ninety-degrees from said upper surface, each first support having a slit therein, the slits being disposed so that the slits of the two first supports lie opposite to each other, the slits being adapted to slidingly receive a circuit board therebetween.

10. The vacuum canister as defined in claim 9, further comprising a second circuit board bracket, the second circuit board bracket comprising a pair of spaced-apart upright second supports, each second support extending upwardly at generally ninety-degrees to said upper surface, each second support having a second slit therein, the second slits being disposed so that the second slits of the two second supports lie opposite to each other, the second slits being adapted to slidingly receive a circuit board; wherein the distance between the first supports of the first circuit board bracket is smaller than the distance between the second supports of the second circuit board bracket.

11. The vacuum canister as defined in claim 10, further comprising a pair of gussets, one gusset connecting each second support to the mounting bracket.

12. The vacuum canister as defined in claim 10, wherein the first and second circuit board brackets are integrally formed with the mounting bracket.

13. The vacuum canister as defined in claim 8, further comprising a stop member disposed between the supports, the stop member being adapted to receive an end of a circuit board thereon.

14. The vacuum canister as defined in claim 1, further comprising a filter support extending outwardly from the lower surface of said mounting bracket, wherein said filter support is concentric with the bore.

15. The vacuum canister as defined in claim 14, wherein said filter support is frusto-conical in shape, having a wider diameter proximate the lower surface of said mounting bracket and tapering in diameter away from the lower surface.

16. The vacuum canister as defined in claim 15, wherein said filter support has an interior that is hollow and said interior is continuous with the bore.

17. The vacuum canister as defined in claim 16, wherein said filter support is integrally formed with said mounting bracket.

18. The vacuum canister as defined in claim 16, wherein said filter support includes a plurality of apertures therein, said apertures opening into the interior of said filter support, thereby allowing for air flow from the dirt collection chamber of the canister through the bore and into the clean chamber.

19. The vacuum canister as defined in claim 15, wherein said filter support terminates in an end cap remote from the lower surface of said mounting bracket.

20. The vacuum canister as defined in claim 19, further comprising a mounting post disposed on the end cap, said mounting post being adapted to be locked to a filter that is received on said filter support.

21. The vacuum canister as defined in claim 20, wherein said mounting post includes a pair of lock posts.

22. The vacuum canister as defined in claim 21, wherein said mounting post includes a pair of release posts.

23. The vacuum canister as defined in claim 22, further comprising a locking member releasably connected to said mounting post, said locking member being selectively rotatable between a first position and a second position; the first position being one in which the locking member is in a released state wherein the filter may be removed from or installed on said filter support; the second position being one in which the locking member is in a locked state wherein the filter is locked onto said filter support.

24. The vacuum canister as defined in claim 23, wherein said locking member comprises a pair of detents adapted to engage said release posts when said locking member is in a first released position.

25. The vacuum canister as defined in claim 24, wherein said locking member defines a pair of slots and said slots are adapted to clear the lock posts when said locking member is in the released position.

26. The vacuum canister as defined in claim 25, wherein said locking member has opposing edges, said edges being adapted to engage said lock posts when said locking member is in a locked position.

27. The vacuum canister as defined in claim 26, wherein the mounting post is oblong is shape.

28. The vacuum canister as defined in claim 15, wherein said dirt collection chamber includes a suction intake pipe and said canister further includes an air deflector, said air deflector being mounted on the lower surface of said mounting bracket a spaced distance from said filter support, said air deflector having a lower edge that extends below an ingress point of the suction intake pipe.

29. The vacuum canister as defined in claim 1, wherein said housing has a wall and the wall includes a projection extending inwardly therefrom, and wherein the lower surface of said mounting bracket includes a lip and the lip engages said projection to secure said mounting bracket within said housing.

30. A vacuum canister for use in association with a central vacuum system, the vacuum canister comprising:

a housing having an outer wall that terminates at a lower edge, said housing including;

an upper chamber; and a lower chamber, said upper and lower chambers being separated from each other by an interior wall which has an opening therein;

a filter disposed in the lower chamber and over the opening; said filter being adapted to remove particulate matter from air flowing from the lower chamber to the upper chamber;

a collection bin removably positioned beneath the lower chamber of the housing; the bin having an upper edge disposed adjacent the lower edge of the housing; said bin including an interior cavity adapted to retain filtered particulate matter therein;

a funnel adapted to direct particulate matter into the interior cavity of the bin; said funnel having a circumferential flange that extends outwardly beyond both of the upper edge of the bin and lower edge of the housing;

a resilient seal;

disposed around the flange; and a plurality of latches disposed on the outer wall of the housing and on an exterior wall of the bin; whereby engagement of the latches secures the housing and bin together and traps the seal and flange therebetween.

* * * * *